US012055026B2

(12) United States Patent
Xiao et al.

(10) Patent No.: US 12,055,026 B2
(45) Date of Patent: Aug. 6, 2024

(54) SOLID TRAP FOR ESP APPLICATIONS

(71) Applicant: SAUDI ARABIAN OIL COMPANY, Dhahran (SA)

(72) Inventors: Jinjiang Xiao, Dhahran (SA); Hattan M. Banjar, Dhahran (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 27 days.

(21) Appl. No.: 17/810,120

(22) Filed: Jun. 30, 2022

(65) Prior Publication Data

US 2024/0003237 A1 Jan. 4, 2024

(51) Int. Cl.

| | |
|---|---|
| ***E21B 43/38*** | (2006.01) |
| ***E21B 31/08*** | (2006.01) |
| ***E21B 43/12*** | (2006.01) |
| ***E21B 43/34*** | (2006.01) |

(52) U.S. Cl.

CPC ..... *E21B 43/35* (2020.05); *E21B 31/08* (2020.05); *E21B 43/128* (2013.01); *E21B 43/38* (2013.01)

(58) Field of Classification Search

CPC ..... E21B 43/35; E21B 43/128

See application file for complete search history.

(56) References Cited

U.S. PATENT DOCUMENTS

| | | | | |
|---|---|---|---|---|
| 2,267,459 | A * | 12/1941 | Hait | E21B 43/38 418/48 |
| 2014/0014358 | A1* | 1/2014 | Leitch | E21B 43/08 166/105.4 |
| 2016/0333681 | A1 | 11/2016 | Mazzanti | |
| 2019/0203565 | A1 | 7/2019 | Reed et al. | |
| 2019/0309768 | A1* | 10/2019 | Todd | E21B 43/35 |
| 2020/0032617 | A1 | 1/2020 | Ejim et al. | |
| 2020/0173267 | A1 | 6/2020 | Leitch | |

* cited by examiner

*Primary Examiner* — Robert E Fuller

(74) *Attorney, Agent, or Firm* — Osha Bergman Watanabe & Burton LLP

(57) ABSTRACT

A system includes a solids trap disposed in a well. The system includes an inner annulus, an outer annulus, and a chamber between the inner annulus and the outer annulus. A solids accumulation zone is formed in the chamber. A pump is fluidly connected to the solids trap. A fluid stream carrying solids flows from the pump. The fluid stream carrying solids is configured to follow a path delimited by the outer annulus and the chamber until the fluid stream deposits the solids in the solids accumulation zone and departs the solids trap via the inner annulus into a tubing.

17 Claims, 5 Drawing Sheets

SOLID TRAP FOR ESP APPLICATIONS

BACKGROUND

In hydrocarbon well development, it is common practice to use electrical submersible pumping systems (ESPs) as a primary form of artificial lift. A challenge with ESP operations is sand and solids precipitation and deposition on top of the ESP string. In order to reduce the need to remove the ESP from the well to perform well intervention operations downhole, a sand trap device is employed in which the ESP pumps fluid through the sand trap.

During the production phase, a common incident can occur where solids fallback into the ESP stages which can cause the ESP to get stuck or fail. Deposition of solids can result in an increase in ESP trips, failures, and jams. The ESP and equipment downhole must be pulled and reinstalled. Executing ESP pulls and reinstalls can be a costly and time-consuming procedure. Accordingly, there exists a need for a device to control flow direction and prevent solids from falling back into the ESP stages.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

In one aspect, embodiments disclosed herein relate to a system comprising: a solids trap disposed in a well and comprising an inner annulus, an outer annulus, and a chamber between the inner annulus and the outer annulus, wherein a solids accumulation zone is formed in the chamber; a pump fluidly connected to the solids trap; and a fluid stream carrying solids flowing from the pump, wherein the fluid stream carrying solids is configured to follow a path delimited by the outer annulus and the chamber until the fluid stream deposits the solids in the solids accumulation zone and departs the solids trap via the inner annulus into a tubing.

In one aspect, embodiments disclosed herein relate to a method comprising: installing a tubing in a well, providing an annular space between a casing and the tubing; providing a solids trap in the annular space and having an upper and a lower connection in fluid communication with the tubing, wherein the solids trap comprises an inner annulus, outer annulus, and a chamber between the inner annulus and the outer annulus; installing a pump for pumping fluid from the lower connection to the upper connection of the solids trap; pumping fluid containing solids, via the pump, from the well through a flow path delimited by the outer annulus and the chamber; forming a solids accumulation zone, via the flow path, in the chamber between the pump and the tubing; depositing solids into the solids accumulation zone, via the flow path; and departing the solids trap, via the inner annulus, into the tubing.

Other aspects and advantages of the claimed subject matter will be apparent from the following description and the appended claims.

BRIEF DESCRIPTION OF DRAWINGS

Specific embodiments of the disclosed technology will now be described in detail with reference to the accompanying figures. Like elements in the various figures are denoted by like reference numerals for consistency.

DETAILED DESCRIPTION

Figure 1:
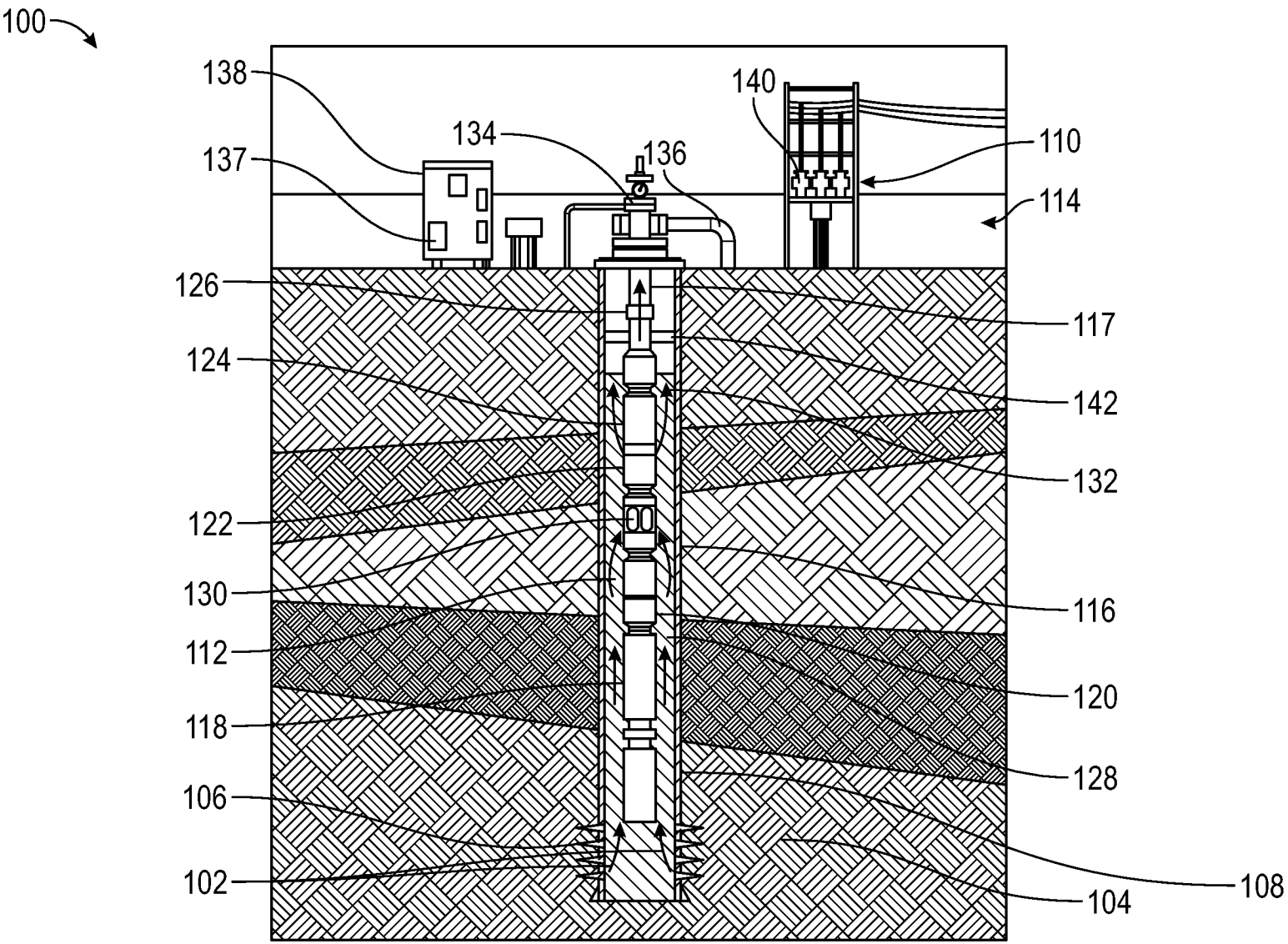
FIG. 1 shows an exemplary well with an Electrical Submersible Pump (ESP) completion design in accordance with one or more embodiments.

Specific embodiments of the disclosed technology will now be described in detail with reference to the accompanying figures. Like elements in the various figures are denoted by like reference numerals for consistency. The sizes and relative positions of elements in the drawings are not necessarily drawn to scale. For example, the shapes of various elements and angles are not necessarily drawn to scale, and some of these elements may be arbitrarily enlarged and positioned to improve drawing legibility. Further, the particular shapes of the elements as drawn are not necessarily intended to convey any information regarding the actual shape of the particular elements and have been solely selected for ease of recognition in the drawing.

In the following detailed description of embodiments of the disclosure, numerous specific details are set forth in order to provide a more thorough understanding of the disclosure. However, it will be apparent to one of ordinary skill in the art that the disclosure may be practiced without these specific details. In other instances, well-known features have not been described in detail to avoid unnecessarily complicating the description.

Throughout the application, ordinal numbers (e.g., first, second, third, etc.) may be used as an adjective for an element (i.e., any noun in the application). The use of ordinal numbers is not to imply or create any particular ordering of the elements nor to limit any element to being only a single element unless expressly disclosed, such as using the terms "before", "after", "single", and other such terminology. Rather, the use of ordinal numbers is to distinguish between the elements. By way of an example, a first element is distinct from a second element, and the first element may encompass more than one element and succeed (or precede) the second element in an ordering of elements.

Embodiments disclosed herein relate to a device for trapping solids by controlling the direction of flow in a well with solids production.

FIG. 1 shows an exemplary Electrical Submersible Pump (ESP) system (100). The ESP system (100) is one example of an artificial lift system that is used to help produce fluids (102) from a formation (104). The well (116) may be open hole or include perforations (106). Perforations (106) in the well's (116) casing string (108) may provide a conduit for the produced fluids (102) to enter the well (116) from the formation (104). An ESP system (100) is an example of the artificial lift system, ESP system and artificial lift system may be used interchangeably within this disclosure. The ESP system (100) includes surface equipment (110) and an ESP string (112). The ESP string (112) is deployed in a well (116) and the surface equipment (110) is located on the surface (114). The surface (114) is any location outside of the well (116), such as the Earth's surface.

The ESP string (112) may include a motor (118), motor protectors (120), a gas separator (122), a multi-stage centrifugal pump (124) (herein called a "pump" (124)), and an electrical cable (126). The ESP string (112) may also include various pipe segments of different lengths to connect the components of the ESP string (112). The motor (118) is a downhole submersible motor (118) that provides power to the pump (124). The motor (118) may be a two-pole, three-phase, squirrel-cage induction electric motor (118). The motor's (118) operating voltages, currents, and horsepower ratings may change depending on the requirements of the operation.

The size of the motor (118) is dictated by the amount of power that the pump (124) requires to lift an estimated volume of produced fluids (102) from the bottom of the well (116) to the surface (114). The motor (118) is cooled by the produced fluids (102) passing over the motor housing. The motor (118) is powered by the electrical cable (126). The electrical cable (126) may also provide power to downhole pressure sensors or onboard electronics that may be used for communication. The electrical cable (126) is an electrically conductive cable that is capable of transferring information. The electrical cable (126) transfers energy from the surface equipment (110) to the motor (118). The electrical cable (126) may be a three-phase electric cable that is specially designed for downhole environments. The electrical cable (126) may be clamped to the ESP string (112) in order to limit electrical cable (126) movement in the well (116). In further embodiments, the ESP string (112) may have a hydraulic line that is a conduit for hydraulic fluid. The hydraulic line may act as a sensor to measure downhole parameters such as discharge pressure from the outlet of the pump (124).

Motor protectors (120) are located on top the motor (118) in the ESP string (112). The motor protectors (120) are a seal section that houses a thrust bearing. The thrust bearing accommodates axial thrust from the pump (124) such that the motor (118) is protected from axial thrust. The seals isolate the motor (118) from produced fluids (102). The seals further equalize the pressure in the annulus (128) with the pressure in the motor (118). The annulus (128) is the space in the well (116) between the casing string (108) and the ESP string (112). The pump intake (130) is the section of the ESP string (112) where the produced fluids (102) enter the ESP string (112) from the annulus (128).

The pump intake (130) is located above the motor protectors (120) and below the pump (124). The depth of the pump intake (130) is designed based off of the formation (104) pressure, estimated height of produced fluids (102) in the annulus (128), and optimization of pump (124) performance. If the produced fluids (102) have associated gas, then a gas separator (122) may be installed in the ESP string (112) above the pump intake (130) but below the pump (124). The gas separator (122) removes the gas from the produced fluids (102) and injects the gas (depicted as separated gas (132) in FIG. 1) into the annulus (128). If the volume of gas exceeds a designated limit, a gas handling device may be installed below the gas separator (122) and above the pump intake (130).

The pump (124) is located above the gas separator (122) and lifts the produced fluids (102) to the surface (114). The pump (124) has a plurality of stages that are stacked upon one another. Each stage contains a rotating impeller and stationary diffuser. As the produced fluids (102) enter each stage, the produced fluids (102) pass through the rotating impeller to be centrifuged radially outward gaining energy in the form of velocity. The produced fluids (102) enter the diffuser, and the velocity is converted into pressure. As the produced fluids (102) pass through each stage, the pressure continually increases until the produced fluids (102) obtain the designated discharge pressure and has sufficient energy to flow to the surface (114).

In other embodiments, sensors may be installed in various locations along the ESP string (112) to gather downhole data such as pump intake volumes, discharge pressures, shaft speeds and positions, and temperatures. The number of stages is determined prior to installation based of the estimated required discharge pressure. Over time, the formation (104) pressure may decrease and the height of the produced fluids (102) in the annulus (128) may decrease. In these cases, the ESP string (112) may be removed and resized. Once the produced fluids (102) reach the surface (114), the produced fluids (102) flow through the wellhead (134) into production equipment (136). The production equipment (136) may be any equipment that can gather or transport the produced fluids (102) such as a pipeline or a tank.

The remainder of the ESP system (100) includes various surface equipment (110) such as electric drives (137), production controller (138), the control module, and an electric power supply (140). The electric power supply (140) provides energy to the motor (118) through the electrical cable (126). The electric power supply (140) may be a commercial power distribution system or a portable power source such as a generator. The production controller (138) is made up of an assortment of intelligent unit-programmable controllers and drives which maintain the proper flow of electricity to the motor (118) such as fixed-frequency switchboards, soft-start controllers, and variable speed controllers. The production controller (138) may be a variable speed drive (VSD), well choke, inflow control valve, and/or sliding sleeves. The production controller (138) is configured to perform automatic well operation adjustments. The electric drives (137) may be variable speed drives which read the downhole data, recorded by the sensors, and may scale back or ramp up the motor (118) speed to optimize the pump (124) efficiency and production rate. The electric drives (137) allow the pump (124) to operate continuously and intermittently or be shut-off in the event of an operational problem.

Figure 2:
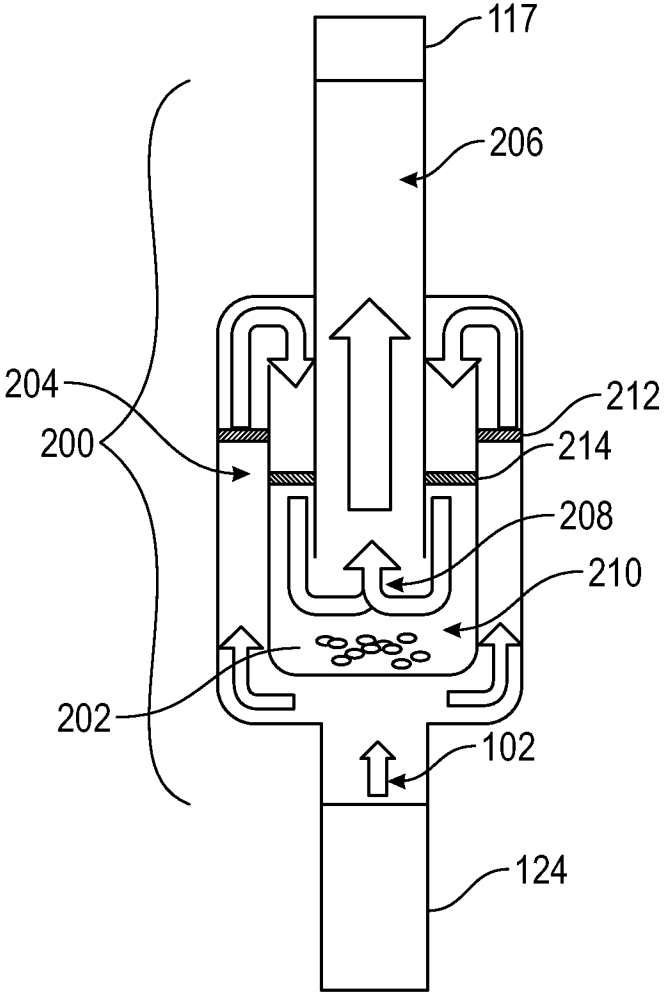
FIG. 2 shows a device, in accordance with one or more embodiments.

FIG. 2 shows a device in accordance with one or more embodiments. In some embodiments, the ESP system (100) includes a solids trap (200) disposed in a well (116). The solids trap (200) may be located in the production tubing (117). The solids trap (200) may be installed above the pump (124). The solids trap (200) may be centered with respect to the production tubing (117) and pump (124). The pump (124) may be fluidly connected to the solids trap (200) allowing the produced fluids (102) to flow from the pump (124). In one or more embodiments, the produced fluids (102) may be a fluid stream carrying solids (202). The fluid stream carrying solids may contain a liquid component and solids. Solids (202) such as salt, sand, and other particles may be found in the produced fluids (102). It is common in the industry for flow to cease during production. The cease of flow may be caused by an ESP system (100) trip or a common shutdown. The density difference between solids (202) and produced fluids (102) during the cease of flow may cause solids (202) to fall back into the pump (124) or pump stages. Solids (202) may fill the impellers and diffusers of the pump (124). Solids (202) may plug fluid paths causing a decrease in flow rate.

The solids trap (200) may include but is not limited one or more paths for produced fluid (102) to flow. The solids trap (200) may be made of any material capable of handling erosion from flowing solids at high velocities and withstanding solid impingement such as stainless steel. The decision of the material of the solids trap (200) may be affected by economics. Specific to this embodiment, the solids trap (200) includes an outer annulus (204), an inner annulus (206), and a chamber (208). The outer annulus (204) may be of tube shape in the outer portion of the solids trap (200). The inner annulus (206) may be of tube shape in the inner portion of the solids trap (200). The chamber (208) may be a containment structure between the outer annulus (204) and the inner annulus (206). The produced fluids (102) may follow a path in the solids trap (200) delimited by the outer annulus (204) and the chamber (208). The outer annulus (204) may be a structure that allows the produced fluids (102) to flow from the pump (124) into the solids trap (200). The outer annulus (204) may direct the produced fluids (102) flow to reverse in direction into the chamber (208). The chamber (208) may produce a solids accumulation zone (210). The solids accumulation zone (210) may allow solids (202) to settle and separate from the produced fluids (102). The solids (202) may fall back into the solids accumulation zone (210). The chamber (208) may direct the produced fluids (102) to reverse in direction from the solids accumulation zone (210) into the inner annulus (204). The inner annulus (206) may allow the produced fluids (102) to depart from the solids trap (200) and into the production tubing (117). The inner annulus (206) may be of the same circumference as the production tubing (117). The produced fluids (102) may have less solids (202) flowing from the chamber (208).

The produced fluids (102) flow may be directed through walls of the solids trap (200). The walls of the solids trap (200) may be cylindrical in shape. Supports may support the walls of the solids trap (200). Supports may be of round shape with an inner diameter and multiple holes around the inner diameter. Supports may come in varied sizes and shapes. Supports may be designed to allow fluid to flow. The material of supports available industry wide include but is not limited to stainless steel, epoxy, and bituminous. The solids trap (200) may include at least two type A supports (212) in between the inner walls of the outer annulus (204) and outer wall of the chamber (208). The solids trap (200) may further include at least two type B supports (214) in between the inner walls of the chamber (208) and the outer walls of the inner annulus (206). Type A support (212) is larger in size than the type B support (214). The size of the supports is dependent on the size of the annular space in the solids trap (200). Specific to this embodiment, the outer annulus (204) is larger than the chamber (208).

Figure 3A:
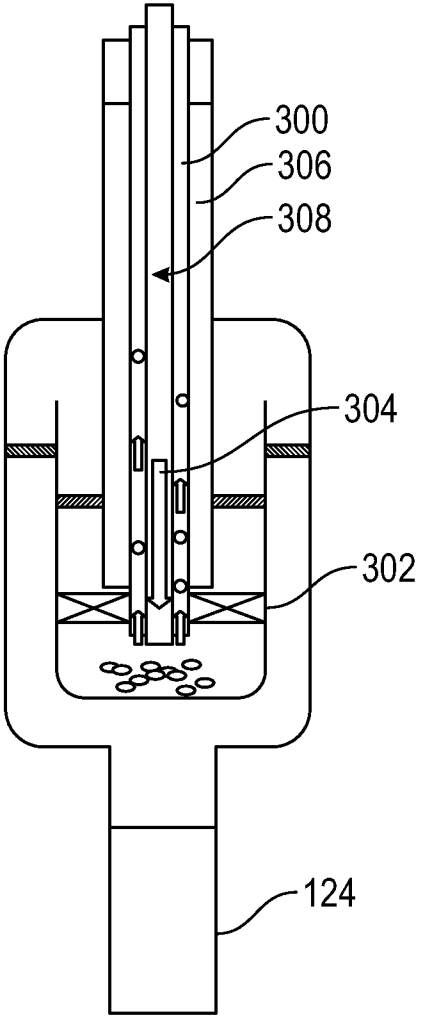
FIGS. 3A-3C shows cleaning components, in accordance with one or more embodiments.

Several forms of a cleaning component for a solids trap (200), in accordance with one or more embodiments, are shown in FIG. 3. As described in FIG. 2, the solids accumulation zone (210) may collect solids (202). The solids accumulation zone (210) may be cleaned. FIG. 3A shows a dual concentric coil tubing (DCT) (300) with an inflatable packer (302). The DCT (300) may include two concentric coil tubing strings that form a separate circulation system. The DCT (300) may be in the production tubing (117) and inside the solids trap (200). The DCT (300) may include an inner concentric coil tubing (ICT) (304) and an outer concentric coil tubing (OCT) (306). The OCT (306) may surround the ICT (304). The inflatable packer (302) is a type of packer (142) that may expand against the solids trap (200). The inflatable packer (302) may use an inflatable bladder for expansion. The inflatable packer (302) may be set below the production tubing (117) and above the solids accumulation zone (210). The inflatable packer (302) may expand against the inner wall of the chamber (208) and the OCT (306). Power fluid (308) may be injected through the ICT (304). Power fluid (308) may contain a fluid such as water or diesel. The power fluid (308) may flow through the DCT (300) collecting solids (202) in the solids accumulation zone (210) and circulated back to surface (114).

Figure 3C:
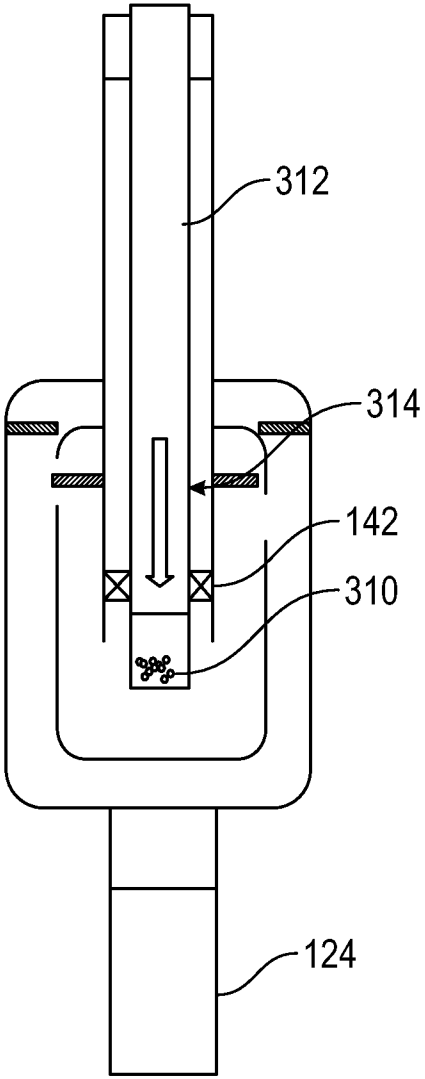
Figure 3B:
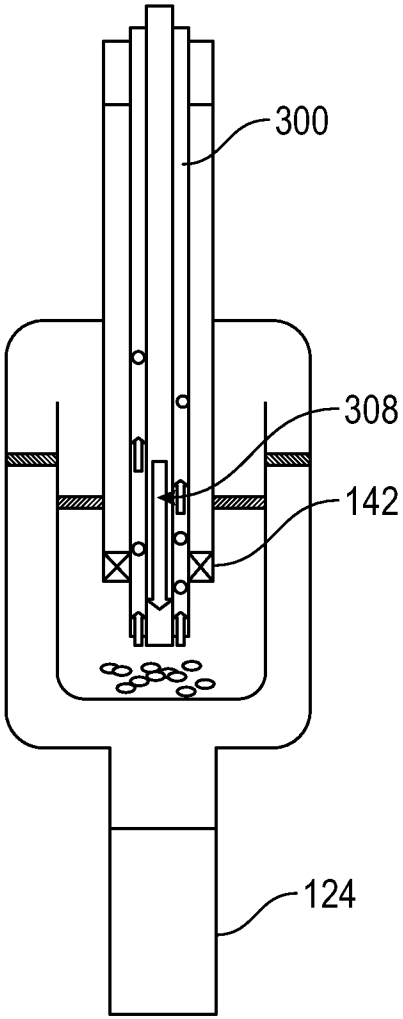

FIG. 3B shows the dual concentric coil tubing (DCT) (300) with a packer (142). The packer (142) may be set above a DCT shoe. The DCT shoe is located above the solids accumulation zone (210). The DCT shoe may be the lower most section of the production tubing (117). The power fluid (308) may be injected through the ICT (304). The power fluid (308) with solids (202) may flow through a path of least resistance. The path of least resistance may be the OCT (306).

FIG. 3C shows a venturi junk basket (310) in a coil tubing (312). The coil tubing (312) may be a single tubing. The venturi junk basket (310) is a commercial product known in the industry to one skilled in the art. The venturi junk basket (310) may collect solids (202). A chemical liquid (314) may be injected through the string of the coil tubing (312). The chemical liquid (314) may be liquid, nitrified fluids, or gases such as nitrogen. The chemical liquid (314) may enter the venturi chamber with solids (202) and be captured in the venturi basket (310). The chemical liquid (314) with solids (202) may exit through the coil tubing (312). The venturi junk basket (310) may be utilized more than once.

Figure 4:
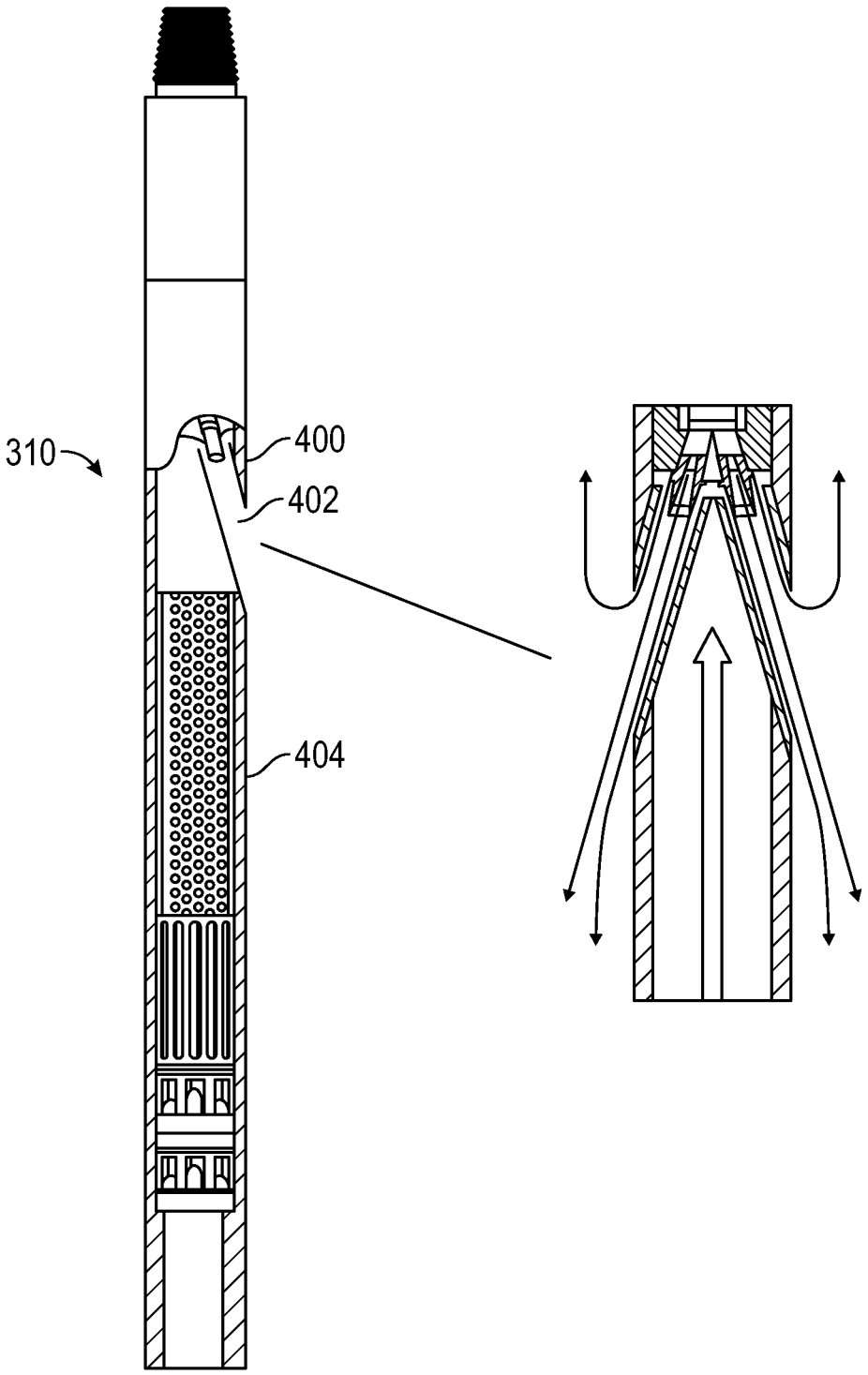
FIG. 4 shows an embodiment of a venturi junk basket useful in conjunction with the one or more embodiments in FIG. 3C.

FIG. 4 shows an embodiment of the venturi junk basket (310) useful in conjunction with the one or more embodiments in FIG. 3C. The venturi junk basket (310) may be a type of vacuum sand bailer used to remove large particles, junk, and debris from the well (116) such as solids (202). The venturi junk basket (310) may be of any size smaller than the production tubing (117). The venturi junk basket (310) may include one or more nozzles (400) and a venturi chamber (402). The nozzles (400) of the venturi junk basket (310) may allow the chemical liquid (314) to flow through and enter the venturi chamber (402) creating a vacuum. The chemical liquid (314) including the solids (202) may be sucked from the bottom of the venturi junk basket (310) and exits through any tubing connected to the venturi junk basket (310), such as coil tubing (312). Part of the chemical liquid (314) with solids (202) may return to the surface (114). The venturi junk basket (310) may recirculate the chemical liquid (314) around the bottom of the venturi junk basket (310). The venturi junk basket (310) may include a debris screen (404) to prevent solids (202) from blocking the coil tubing (312). The debris screen (404) may be located below the venturi chamber (402).

Figure 5:
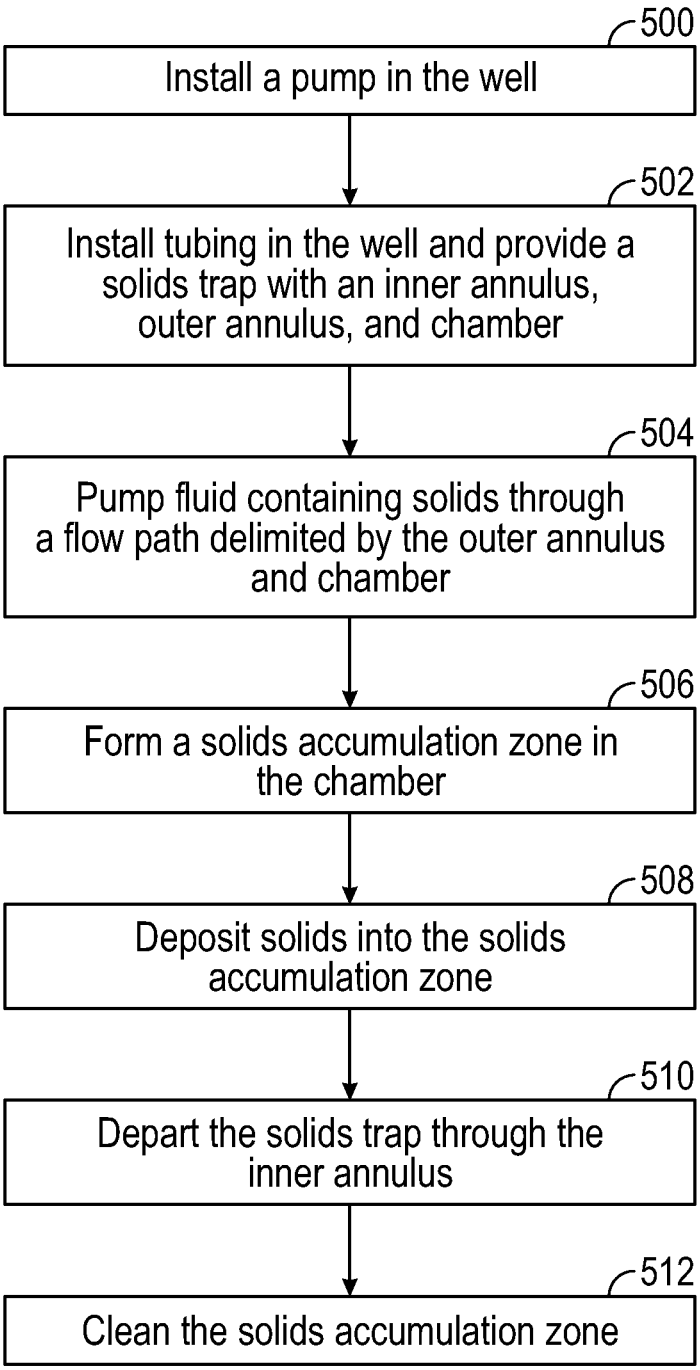
FIG. 5 shows a flowchart, in accordance with one or more embodiments.

FIG. 5 shows a flowchart in accordance with one or more embodiments. Specifically, FIG. 5 shows a method for the solids trap (200). One or more blocks in FIG. 5 may be performed using one or more components as described in FIGS. 1 through 4. While the various blocks in FIG. 5 are presented and described sequentially, one of ordinary skill in the art will appreciate that some or all of the blocks may be executed in a different order, may be combined or omitted, and some or all of the blocks may be executed in parallel and/or iteratively. Furthermore, the blocks may be performed actively or passively.

In Block 500, the pump (124) is installed in the well. The pump (124) may be part of an artificial lift system. In Block 502, production tubing (117) is installed in the well (116) and the solids trap (200) with an inner annulus (206), an outer annulus (204), and a chamber (208) is provided in an annular space of the production tubing (117). The production tubing (117) provides the annular space between the casing string (108) and the production tubing (117). The annular space may be the annulus (128). At least two type A supports (212) fitted in the outer annulus (204) are installed. The type A supports (212) may support the inner wall of the outer annulus (204) and the outer wall of the chamber (208). At least two type B supports (214) fitted in between the chamber (208) and the inner annulus (206). The type B supports (214) may support the outer wall of the inner annulus (206) and the inner wall of the chamber (208). The solids trap (200) may have an upper connection and a lower connection in fluid communication with the production tubing (117).

In Block 504, the pump (124) pumps fluid containing solids (202) through a flow path delimited by the outer annulus (204) and the chamber (208). The fluid may be produced fluid (102) pumped from the well. The pump (124) may pump fluid from the lower connection to the upper connection of the solids trap (200). In Block 506, a solids accumulation zone (210) is formed in the chamber (208) via the flow path. The solids accumulation zone (210) may be between the pump (124) and the production tubing (117). In Block 508, the produced fluid (102) deposits solids (202) into the solids accumulation zone (210) via the flow path. In Block 510, the produced fluid (102) departs the solids trap (200) through the inner annulus (206) into the production tubing (117).

In Block 512, the solids accumulation zone (210) is cleaned. The solids (202) may be cleaned from the solids accumulation zone (210) by a cleaning component. The cleaning component may include a DCT (300) with a packer (142). The cleaning component may include a venturi junk basket (310) with nitrogen. The solids (202) may be disposed from the solids accumulation zone (210). The pump (124) may then resume pumping fluid containing solids (202) from the well (116) through the solids trap (200).

Although only a few example embodiments have been described in detail above, those skilled in the art will readily appreciate that many modifications are possible in the example embodiments without materially departing from this invention. Accordingly, all such modifications are intended to be included within the scope of this disclosure as defined in the following claims. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. § 112(f) for any limitations of any of the claims herein, except for those in which the claim expressly uses the words 'means for' together with an associated function.

What is claimed is:

1. A system comprising:

a solids trap disposed in a well and comprising an inner annulus, an outer annulus, and a chamber, wherein the chamber is between the inner annulus and the outer annulus such that a flow path is defined from the outer annulus through the chamber to the inner annulus, wherein a solids accumulation zone is formed in the chamber;

a pump fluidly connected to the solids trap; and a fluid stream carrying solids flowing from the pump, wherein the fluid stream carrying solids is configured to follow the flow path by entering the outer annulus and flowing into the chamber until the fluid stream deposits the solids in the solids accumulation zone and departs the solids trap via the inner annulus into a tubing; and a cleaning component configured to clean the solids accumulation zone, the cleaning component comprising a dual concentric coil tubing with a packer.

2. System of claim 1, further comprising:

at least two type A supports fitted in the outer annulus configured to support an inner wall of the outer annulus and an outer wall of the chamber.

3. The system of claim 1, further comprising:

at least two type B supports fitted in between the chamber and the inner annulus configured to support an outer wall of the inner annulus and an inner wall of the chamber.

4. The system of claim 1, wherein the fluid stream carrying solids comprises a liquid component and solids.

5. The system of claim 1, wherein the outer annulus is larger in size than the chamber.

6. The system of claim 1, wherein the tubing is a production tubing.

7. The system of claim 1, wherein the cleaning component further comprises a venturi junk basket with nitrogen.

8. The system of claim 1, wherein a structural orientation of each of the outer annulus, chamber, and inner annulus with respect to one another is configured such that a flow direction of the fluid stream changes at least twice along the flow path.

9. A method comprising:

installing a tubing in a well, providing an annular space between a casing and the tubing;

providing a solids trap in the annular space and having an upper and a lower connection in fluid communication with the tubing, wherein the solids trap comprises an inner annulus, outer annulus, and a chamber, wherein the chamber is between the inner annulus and the outer annulus such that a flow path is defined from the outer annulus through the chamber to the inner annulus;

installing a pump for pumping fluid from the lower connection to the upper connection of the solids trap;

pumping fluid containing solids, via the pump, from the well through the flow path by entering the outer annulus and flowing into the chamber;

forming a solids accumulation zone, via the flow path, in the chamber between the pump and the tubing;

depositing solids into the solids accumulation zone, via the flow path; and departing the solids trap, via the inner annulus, into the tubing; and cleaning the solids out of the chamber in the solids trap using a dual concentric coil tubing with a packer.

10. The method of claim 9, further comprising:

disposing of the solids from the solids accumulation zone; and resuming pumping fluid containing solids from the well through the solids trap.

11. The method of claim 9, further comprising:

installing at least two type A supports fitted in the outer annulus configured to support an inner wall of the outer annulus and an outer wall of the chamber.

12. The method of claim 9, further comprising:

installing at least two type B supports fitted in between the chamber and the inner annulus configured to support an outer wall of the inner annulus and an inner wall of the chamber.

13. The system of claim 9, wherein the outer annulus is larger in size than the chamber.

14. The method of claim 9, wherein the fluid comprises a liquid component and solids.

15. The method of claim 9, wherein the tubing is a production tubing.

16. The method of claim 10, wherein cleaning the solids out of the solids trap comprises using a venturi junk basket with nitrogen.

17. The method of claim 9, further comprising configuring a structural orientation of each of the outer annulus, chamber, and inner annulus with respect to one another such that a flow direction of the fluid changes at least twice along the flow path.

* * * * *